US006488516B2

(12) United States Patent
Osawa et al.

(10) Patent No.: US 6,488,516 B2
(45) Date of Patent: Dec. 3, 2002

(54) LEVER-TYPE CONNECTOR

(75) Inventors: Hiroki Osawa, Yokkaichi (JP); Hajime Kawase, Yokkaichi (JP)

(73) Assignee: Sumitomo Wiring System, Ltd., Mie (JP)

( * ) Notice: Subject to any disclaimer, the term of this patent is extended or adjusted under 35 U.S.C. 154(b) by 0 days.

(21) Appl. No.: 09/843,831

(22) Filed: Apr. 30, 2001

(65) Prior Publication Data

US 2001/0036758 A1 Nov. 1, 2001

(30) Foreign Application Priority Data

May 1, 2000 (JP) ..... 2000-132311

(51) Int. Cl.[7] ..... H01R 13/62
(52) U.S. Cl. ..... 439/157; 439/160
(58) Field of Search ..... 439/152–160, 439/372, 341

(56) References Cited

U.S. PATENT DOCUMENTS 5,476,390 A 12/1995 Taguchi et al. ..... 439/157
5,609,494 A * 3/1997 Yamaguchi et al. ..... 439/157
5,676,556 A * 10/1997 Yamaguchi et al. ..... 439/157
5,810,612 A * 9/1998 Flask et al. ..... 439/157
5,823,809 A * 10/1998 Wakata ..... 439/157
5,904,583 A * 5/1999 Katsuma et al. ..... 439/157
6,039,586 A * 3/2000 Kitamura ..... 439/157
6,193,531 B1 * 2/2001 Ito et al. ..... 439/157
6,203,340 B1 * 3/2001 Yamashita et al. ..... 439/157
6,254,408 B1 * 7/2001 Hattori et al. ..... 439/157

FOREIGN PATENT DOCUMENTS

EP 886 345 12/1998
GB 2 289 171 11/1995

* cited by examiner

*Primary Examiner*—Brian Sircus
*Assistant Examiner*—Son V. Nguyen
(74) *Attorney, Agent, or Firm*—Banner & Witcoff, Ltd.

(57) ABSTRACT

Follower pins 12 of a female housing 10 are fitted into cam grooves 35 of a lever 30 supported by axles on a male housing 20. These two housings 10 and 20 can be fitted together or separated by means of pivoting the lever 30 between a starting position, and an ending position. An upper supporting member 40 is formed at a right side of a hood 23, and a lower supporting member 44. When the lever 30 is pivoted to the starting position or the ending position, a tip thereof is supported by the supporting member 40 or 44, respectively, thereby protecting this tip from contact with other components, etc. The supporting members 40 and 44 protrude into dead space relative to the position of the housing 20. Consequently, no extra space is required when the housing 20 is placed in position, yet the lever 30 has increased length and angle of travel.

9 Claims, 5 Drawing Sheets

PRIOR ART

LEVER-TYPE CONNECTOR

TECHNICAL FIELD

The present invention relates to a lever-type electrical connector.

BACKGROUND TO THE INVENTION

One example of the configuration of a lever-type connector is shown schematically in FIG. 10 of this specification. A male housing 1 of a pair of male and female connector housings that fit together is provided with axles 4, these serving as the fulcrum for a 'U' shaped pivotable lever 3 having cam grooves 2 formed therein. A female housing 5 has follower pins 6 provided thereon, these follower pins 6 being inserted into the cam grooves 2. The two housings 1 and 5 can be fitted together or separated by pivoting the lever 3 between the positions shown by the chain line and the solid line in FIG. 10. An example of this type of lever-type connector is described in JP-6-275337.

This kind of lever-type connector requires little operating force. The operating force can be further reduced by lengthening the lever 3. However, if the lever 3 is lengthened, it protrudes to a greater extent from the male housing 1. Consequently, the lever 3 may strike against other components or equipment, its retained state thereby being released, and a pivoting force being exerted on the lever 3 in an unwanted direction. In order to prevent this, a lever support may be provided which protrudes from the male housing 1 and prevents the tip of the lever 3 from striking against other components, etc. However, providing this lever support results in the male housing 1 becoming even larger in size. This problem cannot be solved easily.

The present invention has taken the above problem into consideration, and aims to increase the length of the lever without this leading to an increase in the size of the housing.

SUMMARY OF THE INVENTION

According to the invention there is provided a lever-type connector having a pair of mutually engageable housings, said housings having a substantially common terminal insertion axis, one of said housings having a lever pivotable thereon about a pivot axis orthogonal to said insertion axis between first and second end portions, and defining a cam, and the other of said housings having a follower engageable with said cam, whereby said lever is operable to draw together and to separate said housings, wherein said one of said housings has a profile in the direction of said insertion axis, and has supporting members protruding in the direction of said insertion axis, and within said profile, said supporting members providing a shield to prevent inadvertent movement of said lever from the first and second positions.

Such a connector permits a longer lever arm whilst not increasing the overall width of the connector in the directions of said pivot axis, and whilst maintaining protection of the lever against inadvertent contact with other components. As a consequence the overall size of the connector is not increased, and operability is improved.

BRIEF DESCRIPTION OF DRAWINGS

Other features of the invention will be apparent from the following description of a preferred embodiment shown by way of example only in the accompanying drawings in which.

DESCRIPTION OF PREFERRED EMBODIMENT

An embodiment of the present invention is described below with the aid of FIGS. 1 to 9.

Figure 1:
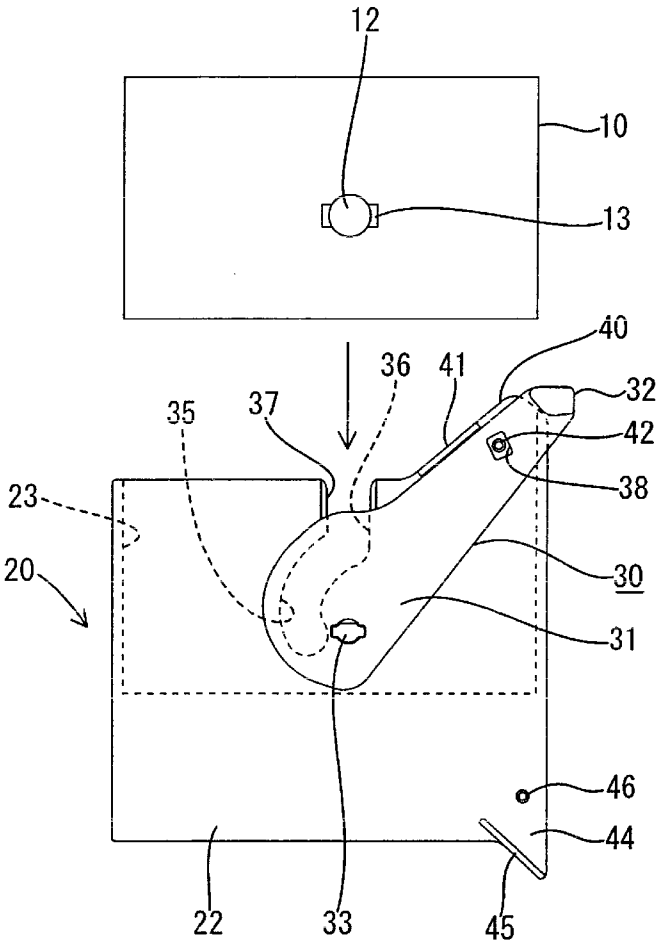
FIG. 1 is a side view of an embodiment of the present invention showing male and female housings prior to being fitted together.

As shown in FIG. 1, a connector of the present embodiment is provided with a female connector housing 10, and a male connector housing 20. The fitting sides of these male and female housings 10 and 20 will hereafter be referred to as the anterior sides.

Figure 2:
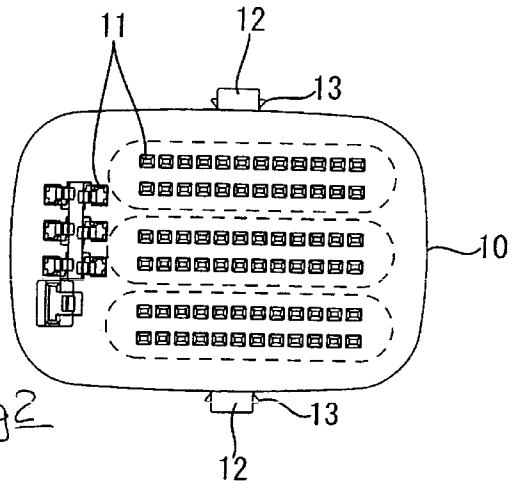
FIG. 2 is a front view of the female housing.

As shown in FIG. 2, the female housing 10 is formed from plastic and has a block shape. A plurality of cavities 11 are aligned therein, these forming terminal fitting insertion holes that are open to the fitting face. Female terminal fittings (not shown) can be inserted from the posterior into these cavities 11.

A pair of follower pins 12 protrude from central portions of both lengthwise side faces of the female housing 10.

Figure 3:
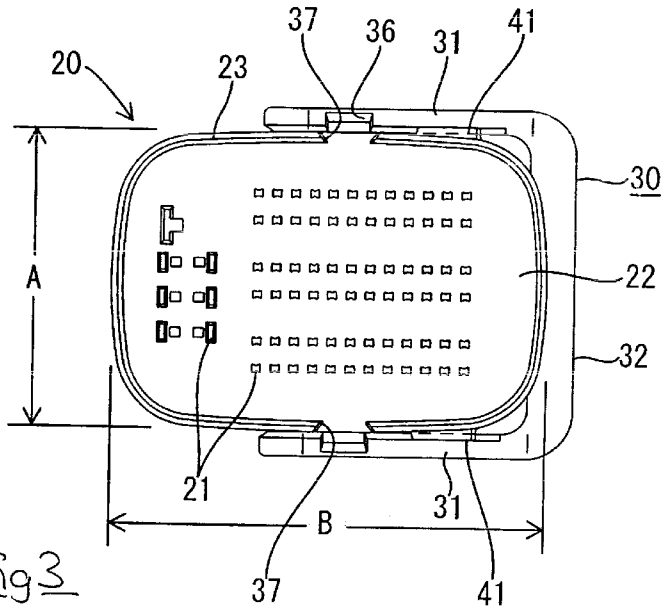
FIG. 3 is a front view of the male housing.
Figure 4:
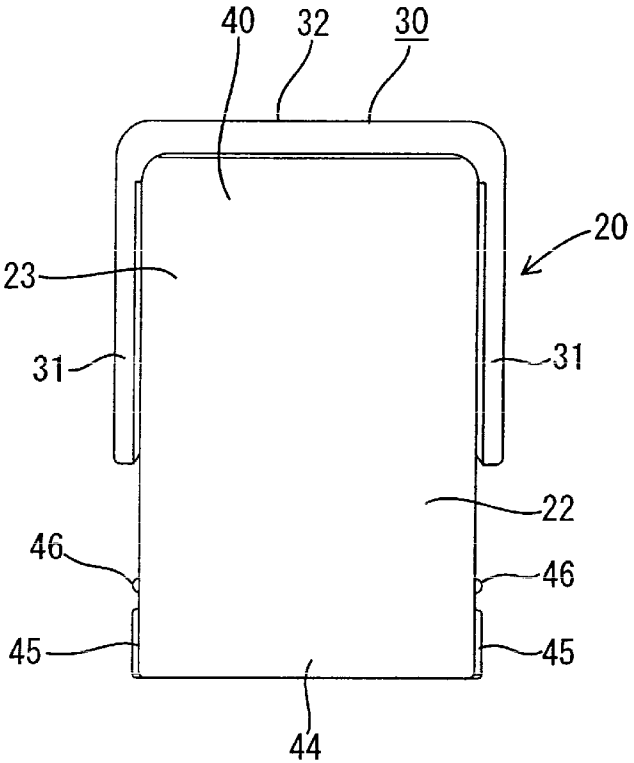
FIG. 4 is a right side face view of the male housing.
Figure 7:
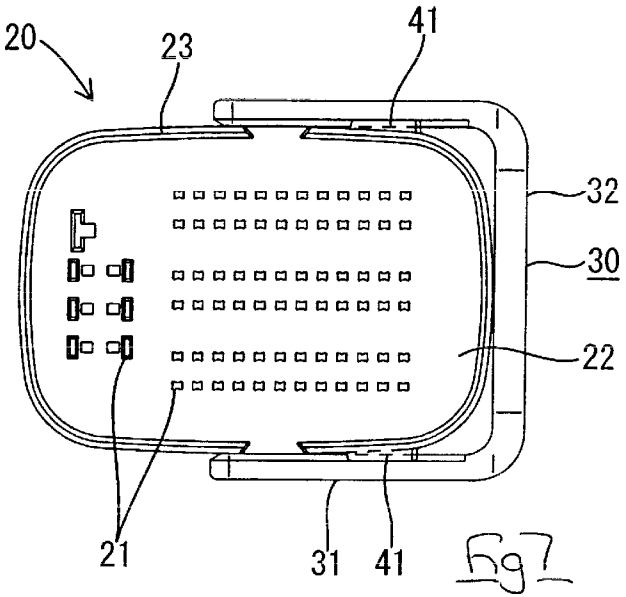
FIG. 7 is a front view showing the male housing as a single component while a lever is in an ending position.
Figure 10:
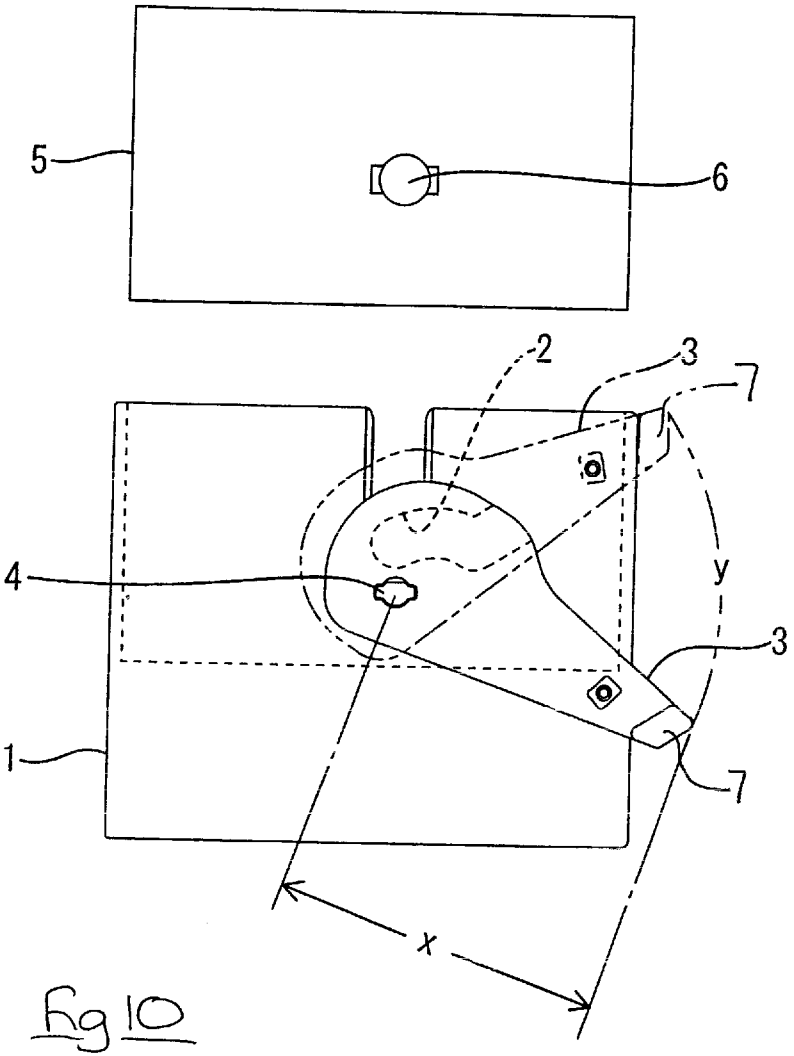
FIG. 10 is a side face view of a prior example.

The male housing 20 is also made from plastic. As shown in FIGS. 3 and 4, a main body 22 thereof has cavities 21 formed therein, and a hood 23, into which the female housing 10 fits, is formed at an anterior face side of this main body 22. A male terminal fitting (not shown) is inserted from the posterior into each cavity 21. Tabs at the tips of these male terminal fittings protrude for a specified length into the hood 23. The vertical dimension A and the horizontal dimension B (see FIG. 3) of the main body 22 (the horizontal cross-sectional face thereof is shown here) of the male housing are the same as those of the male housing 1 shown schematically in FIG. 10.

A lever 30, for performing the fitting operation, is attached to the male housing 20. This lever 30 has a bifurcated shape whereby an operating member 32 joins tips of a pair of arms 31. The lever 30 is attached so as to straddle the male housing 20 from the right side (relative to FIG. 1). Base ends of the arms 31 are supported by axles 33. The lever 30 can be pivoted between a starting position (shown in FIG. 1) and an ending position (shown in FIG. 6).

The base ends of the arms 31 of the lever 30 are wide, cam grooves 35 of a specified shape being formed therein. The follower pins 12 of the female housing 10 fit into these cam grooves 35. When the lever 30 is in the starting position, openings 36 of the cam grooves 35 are open towards the anterior side (see FIGS. 1 and 3). Guiding grooves 37 are formed in side faces, relative to the lengthwise direction, of the hood 23. These guiding grooves 37 are formed by cutting away these side faces from opening edges towards the posterior. Guiding members 13 formed in base portions of the follower pins 12 of the female housing 10 fit into these guiding grooves 37.

An upper supporting member 40 is formed on the right side (relative to FIG. 1) of the hood 23 of the male housing 20. This upper supporting member 40 is located a little to the right relative to the position of the guiding grooves 37, and faces towards a right edge. The upper supporting member 40 rises gradually upwards from a ridge of an opening edge of the hood 23. The upper supporting member 40 protrudes only in the inserting direction of the terminal fittings of the male housing 20; it does not protrude in the widthwise direction (at a right angle to the protruding direction) beyond a side face of the male housing 20. A pair of upper stoppers 41 protrude along outer faces of inclined edges at both sides of the upper supporting member 40, these making contact with edges of one side of anterior ends of the arms 31 of the lever 30. When the lever 30 is pivoted in an anti-clockwise direction (relative to FIG. 1), the arms 31 thereof make contact with the upper stoppers 41, thereby stopping this movement. This position is the starting position of the lever 30.

In this starting position, the operating member 32 of the lever 30 is inclined upwards and to the right. Moreover, the operating member 32 is immediately to the exterior of the upper supporting member 40. Retaining holes 38 are formed on the arms 31 of the lever 30, and first protrusions 42 are formed on the upper supporting member 40. These first protrusions 42 fit into the retaining holes 38, thereby maintaining the lever 30 in the starting position.

A lower supporting member 44 is formed on the right side (relative to FIG. 1) of the main body 22 of the male housing 20. This lower supporting member 44 is approximately symmetrical to the upper supporting member 40. A posterior edge of the lower supporting member 44 faces towards the right, and the lower supporting member 44 gradually retreats towards the posterior. The lower supporting member 44 protrudes only in the inserting direction of the terminal fittings of the male housing 20; it does not protrude in the widthwise direction (at a right angle to the protruding direction) beyond the side face of the male housing 20. A pair of lower stoppers 45 protrude along outer faces of inclined edges at both sides of the lower supporting member 44, these making contact with edges of the other side of the anterior ends of the arms 31 of the lever 30. When the lever 30 is pivoted in a clockwise direction (relative to FIG. 1), the arms 31 make contact with the lower stoppers 45, thereby stopping this movement. This position is the ending position of the lever 30. In this ending position, the operating member 32 of the lever 30 is inclined downwards and to the right. Moreover, the operating member 32 is immediately to the exterior of the lower supporting member 44. Second protrusions 46 are formed on the lower supporting member 44. These second protrusions 46 fit into the retaining holes 38, thereby maintaining the lever 30 in the ending position.

Next, the operation of the present embodiment will be described. When the female and male housings 10 and 20 are to be fitted together, they are positioned so as to face one another, with the lever 30 being maintained in the starting position (see FIG. 1). The tip of the lever 30 is supported on the upper supporting member 40, thereby preventing other components or equipment from striking against it before the fitting operation commences. Even if the operating member 32 is struck and a force is exerted on the lever 30 to pivot it in the anti-clockwise direction (relative to FIG. 1), this rotative force is received by the upper stopper 41, thereby preventing unwanted rotation.

Figure 5:
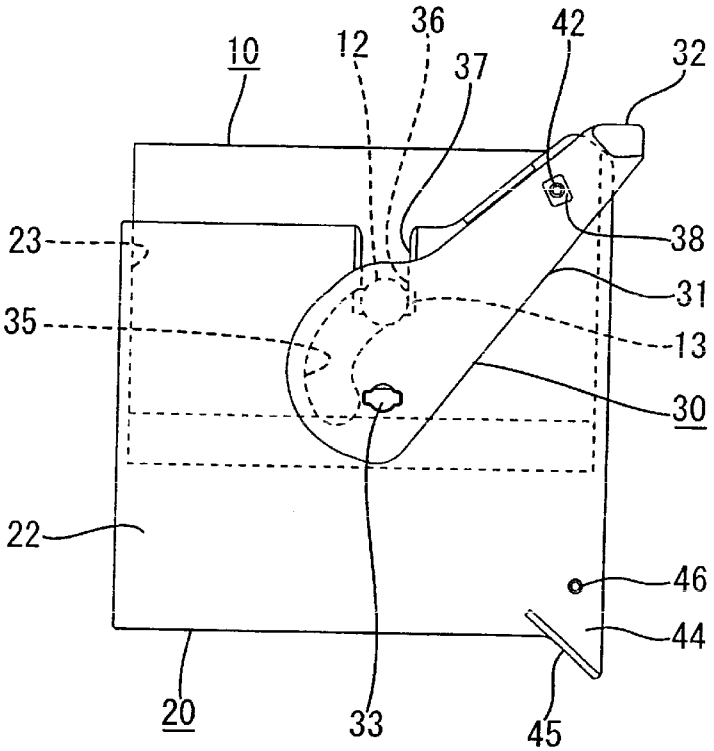
FIG. 5 is a side face view showing the beginning stage of the fitting operating.

From the mutually facing state described above, the guiding members 13 of the female housing 10 are fitted into the guiding grooves 37 of the hood 23, and the female housing 10 is pushed, in the direction shown by the arrow in FIG. 1, into the hood 23. As shown in FIG. 5, the follower pins 12 of the female housing 10 then enter the openings 36 of the cam grooves 35.

Next, the operating member 32 is pushed, thereby pushing the lever 30 downwards (relative to FIG. 5), the lever 30 being pivoted in the clockwise direction (relative to FIG. 5) with the axles 33 serving as the centre and the retaining holes 38 leaving the first protrusions 42. The cam operation of the cam grooves 35 and the follower pins 12 gradually draws the female housing 10 into the hood 23. As the movement of the lever 30 continues, it strikes against the lower stopper 46 (see FIG. 6). This halts the lever 30, and the second protrusions 46 fit into the retaining holes 38, thereby maintaining the lever 30 in the ending position. At this juncture, the female housing 10 is fitted at the innermost end of the hood 23, and the corresponding male and female terminal fittings make contact correctly with one another.

In this ending position, the tip of the lever 30 is supported on the lower supporting member 44, thereby preventing other components or equipment from striking against it. Even if the operating member 32 is struck and a force is exerted on the lever 30 to pivot it in the clockwise direction (relative to FIG. 6), this force is received by the lower stopper 45, thereby preventing unwanted movement.

Figure 6:
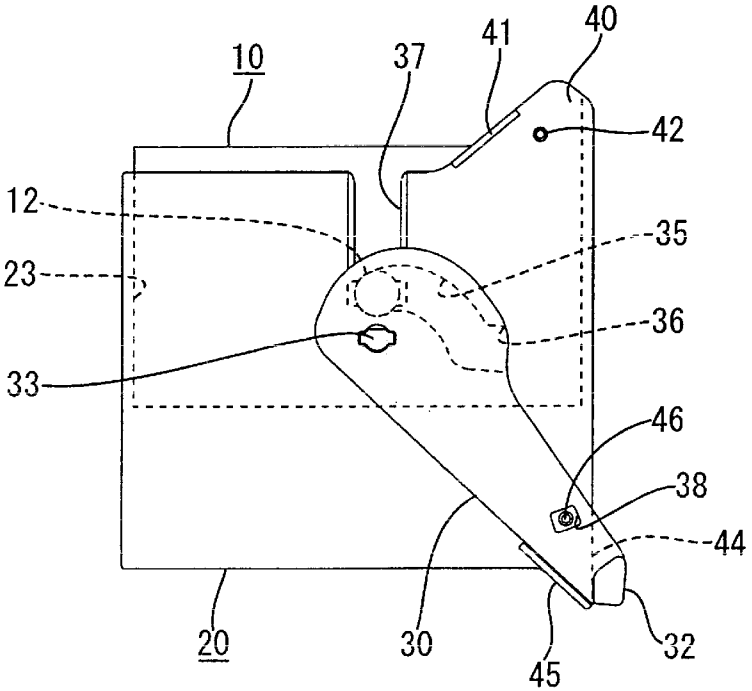
FIG. 6 is a side face view showing the fitting operation in a completed state.

If the female and male housings 10 and 20 are to be separated, the operating member 32 is pushed so as to push the lever 30 upwards (relative to FIG. 6). The retaining holes 38 leave the second protrusions 46 while the lever 30 is being pivoted in the anti-clockwise direction. The cam operation of the cam grooves 35 and the follower pins 12 gradually removes the female housing 10 from the hood 23. As the lever 30 continues, it strikes against the upper stopper 41 (see FIG. 5). This halts the lever 30, and the first protrusions 42 fit into the retaining holes 38, thereby maintaining the lever 30 in the starting position once again. At this juncture, the corresponding male and female terminal fittings are completely separated from one another, and the follower pins 12 have returned to the openings 36 of the cam grooves 35, these openings 36 opening to the anterior. The female housing 10 can then be pulled further, thereby separating the female and male housings 10 and 20.

Figure 9:
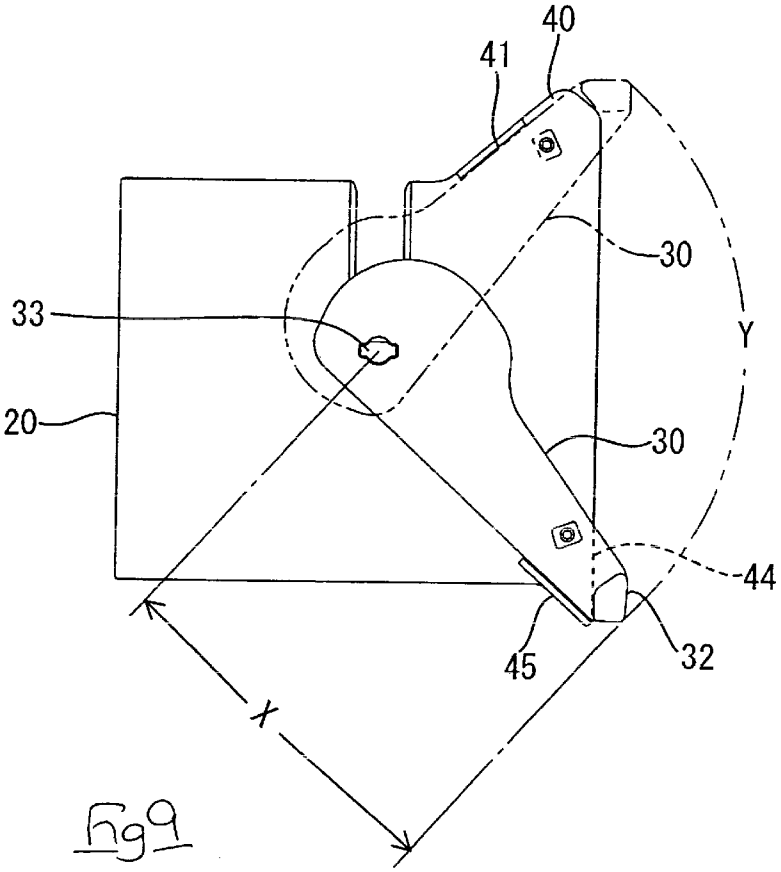
FIG. 9 is a side face view showing a rotative range of the lever.
Figure 8:
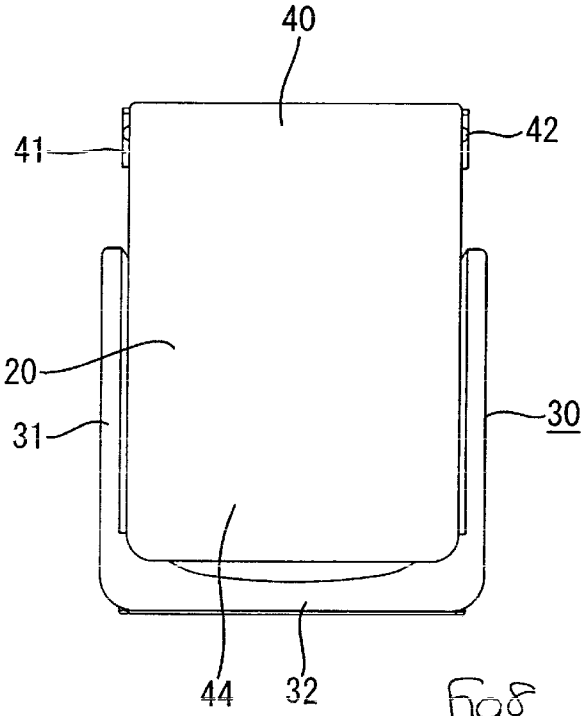
FIG. 8 is a right side face view of FIG. 7.

In the present embodiment, when the lever 30 is pivoted between the starting position and the ending position, shown respectively by the chain line and the solid line in FIG. 9, the tip of its lever is protected by the upper supporting member 40 and the lower supporting member 44 in each respective position. The length X of the lever 30 of the present embodiment is greater than the length x of the lever 3 of the conventional example shown in FIG. 10. Furthermore, the rotative angle Y of the lever 30 is greater than the rotative angle y of the lever 3 of the conventional example, and the incline of the cam grooves 35 is more moderate than in the conventional example. As a result, less force needs to be exerted on the lever 30 when the female and male housings 10 and 20 are to be fitted or separated.

The upper and lower supporting members 40 and 44, for protecting the tip of the lever 30, protrude in the direction of insertion of electric wires. As a result, the dimensions of the male housing 20 in the widthwise direction (that is, the direction at a right angle to the direction of insertion of the electric wires) remain unchanged. The space in the direction of insertion of the electric wires is dead space. Consequently, the connector requires no extra space when it is positioned in place even though the supporting members 40 and 44 protrude in this direction. That is, from the viewpoint of the space required when the connector is put in position, the male housing 20 does not become larger.

The present invention is not limited to the embodiments described above with the aid of figures. For example, the possibilities described below also lie within the technical range of the present invention. In addition, the present invention may be embodied in various other ways without deviating from the scope thereof.

(1) The present invention is equally suited to a type of connector wherein the lever is provided on the female housing.

What is claimed is:

1. A lever-type connector having a pair of mutually engageable housings, said housings having a substantially common terminal insertion axis, one of said housings having a lever pivotable thereon about a pivot axis orthogonal to said insertion axis, and defining a cam, and the other of said housings having a follower engageable with said cam, whereby said lever is operable to draw together and to separate said housings, wherein said one of said housings has a front face for receiving the other of said housings and a rear face for receiving wires, the front and rear faces each having a width and a length perpendicular to the insertion axis which define a profile having a depth that extends in a direction of said insertion axis, a first supporting member protruding from the front face in a direction of said insertion axis beyond the front face within said profile, a second supporting member protruding from the rear face in a direction of said insertion axis beyond the rear face within said profile, each said supporting member providing a stop to prevent movement of said lever past the supporting members.

2. A connector according to claim 1 wherein said lever straddles said one of said housings and comprises arms, each of which is pivoted at one end to said one of said housings for movement about said pivot axis, and a bridge joining the other ends of said arms.

3. A connector according to claim 2 wherein one said supporting member extends along each of opposite sides of said one of said housings within the profile to provide a stop for each of said arms beyond the front and rear faces.

4. A connector according to claim 2 wherein the profile of said one of said housings is substantially rectangular and said stop of each said support member being disposed generally at a corner thereof.

5. A connector according to claim 3 wherein the profile of said one of said housings is substantially rectangular and said stop of each said support member being disposed generally at a corner thereof.

6. A connector according to claim 4 wherein each said supporting member comprises a substantially triangular projection extending beyond one of the front or rear face in a direction of said insertion axis, each supporting member having an upstanding wall on a hypotenuse of the triangular projection as the stop for abutment with said lever.

7. A connector according to claim 4 wherein each said supporting member comprises a substantially triangular projection extending beyond one of the front or rear face in a direction of said insertion axis, each supporting member having an upstanding wall on a hypotenuse of the triangular projection as the stop for abutment with said lever.

8. A connector according to claim 1 and further including a releasable latch to retain said lever against one of said supporting members.

9. A connector according to claim 1 wherein the arc of movement of said lever is about 90°.

* * * * *